US012091066B2

(12) United States Patent
Cole et al.

(10) Patent No.: US 12,091,066 B2
(45) Date of Patent: Sep. 17, 2024

(54) CONTROL SYSTEM FOR OPERATING LONG VEHICLES

(71) Applicants: Central Queensland University, North Rockhampton (AU); Insyte Solutions Pty Ltd, Emu Park (AU)

(72) Inventors: Colin Robert Cole, North Rockhampton (AU); Christopher Graham Bosomworth, Emu Park (AU); Mark James Hayman, Emu Park (AU)

(73) Assignees: Central Queensland University, North Rockhampton (AU); Insyte Solutions Pty Ltd, Emu Park (AU)

( * ) Notice: Subject to any disclaimer, the term of this patent is extended or adjusted under 35 U.S.C. 154(b) by 373 days.

(21) Appl. No.: 17/436,438

(22) PCT Filed: Feb. 24, 2020

(86) PCT No.: PCT/AU2020/050159
§ 371 (c)(1),
(2) Date: Sep. 3, 2021

(87) PCT Pub. No.: WO2020/176924
PCT Pub. Date: Sep. 10, 2020

(65) Prior Publication Data

US 2022/0185345 A1 Jun. 16, 2022

(30) Foreign Application Priority Data

Mar. 4, 2019 (AU) ..... 2019900705
May 24, 2019 (AU) ..... 2019901768

(51) Int. Cl.
*B61L 15/00* (2006.01)
*B61L 27/04* (2006.01)
(Continued)

(52) U.S. Cl.
CPC ..... *B61L 15/0058* (2024.01); *B61L 15/0018* (2013.01); *B61L 15/0062* (2024.01);
(Continued)

(58) Field of Classification Search
CPC ..... B61L 3/006; B61L 3/008; B61L 15/0018; B61L 15/0072; B61L 27/16; B61L 27/20;
(Continued)

(56) References Cited

U.S. PATENT DOCUMENTS 4,253,399 A 3/1981 Spigarelli
4,344,364 A 8/1982 Nickles et al.
(Continued)

FOREIGN PATENT DOCUMENTS

AU 2019200200 A1 2/2019
CN 106672032 A 5/2017
(Continued)

OTHER PUBLICATIONS

Written Openion and International Search Report related to PCT Application No. PCT/AU2020/050159 reported on Mar. 26, 2020.

*Primary Examiner* — Yonel Beaulieu
(74) *Attorney, Agent, or Firm* — von Briesen & Roper, s.c.

(57) ABSTRACT

A method for operating a train comprising two or more locomotives, the method comprising the steps of:

a) Setting one or more locomotive control levels and choosing a selected route of travel;
b) Calculating a target train speed profile and a target in-train force profile over at least a portion of the selected route;
c) Measuring one or more operating parameters related to the operation of the train;
d) Calculating a future train speed profile and a future in-train force profile for a future period based on at least
(Continued)

one of the one or more operating parameters, at least one of the one or more locomotive control levels and one or more pieces of information relating to the selected route;

e) Calculating adjusted locomotive speed control levels relating to the one or more operating parameters based on a difference between the target train speed profile and the future train speed profile, the adjusted locomotive control levels being adapted to maintain the target train speed profile over the future period;

f) Calculating adjusted in-train force control levels relating to the one or more operating parameters based on a difference between the target in-train force profile and the future in-train force profile, the adjusted in-train force control levels being adapted to maintain the target in-train force profile below a target level over the future period;

g) Dividing the adjusted locomotive control levels and the adjusted in-train force control levels between the two or more locomotives to form locomotive-specific locomotive control levels for each of the two or more locomotives, the locomotive-specific locomotive control levels being at least partially adapted to control and/or balance in-train force levels below the target level h) Provide locomotive-specific locomotive control levels for communication to each of the two or more locomotives; and i) Operating each of the two or more locomotives according to the locomotive-specific locomotive control levels.

20 Claims, 3 Drawing Sheets

(51) Int. Cl.
*B61L 27/16* (2022.01)
*B61L 27/20* (2022.01)
*B61L 27/40* (2022.01)

(52) U.S. Cl.
CPC ..... *B61L 15/0072* (2013.01); *B61L 27/16* (2022.01); *B61L 27/20* (2022.01); *B61L 27/04* (2013.01); *B61L 27/40* (2022.01); *B61L 2205/04* (2013.01)

(58) Field of Classification Search
CPC ..... B61L 27/04; B61L 27/40; B61L 2205/04; B61L 27/02
See application file for complete search history.

(56) References Cited

U.S. PATENT DOCUMENTS

| | | | | |
|---|---|---|---|---|
| 5,533,695 | A * | 7/1996 | Heggestad | B61L 27/20 701/19 |
| 6,144,901 | A | 11/2000 | Nickles et al. | |
| 6,332,106 | B1 | 12/2001 | Hawthorne et al. | |
| 7,822,491 | B2 | 10/2010 | Howlett et al. | |
| 8,594,865 | B1 | 11/2013 | Matusiak et al. | |
| 9,233,696 | B2 | 1/2016 | Kumar et al. | |
| 9,365,222 | B2 | 6/2016 | Hawthorne et al. | |
| 9,950,722 | B2 | 4/2018 | Kumar et al. | |
| 2008/0128562 | A1* | 6/2008 | Kumar | B61C 17/12 246/186 |
| 2013/0268147 | A1* | 10/2013 | Chundru | B61C 17/12 701/19 |
| 2023/0286523 | A1* | 9/2023 | Dumas | B60W 50/12 701/1 |

FOREIGN PATENT DOCUMENTS

| | | | | |
|---|---|---|---|---|
| EP | 2497694 | A2 * | 9/2012 | B61C 17/12 |
| EP | 2532563 | A2 | 12/2012 | |
| EP | 2593346 | B1 * | 10/2017 | B61L 25/025 |
| WO | WO-9315946 | A1 * | 8/1993 | B60T 13/665 |

* cited by examiner

CONTROL SYSTEM FOR OPERATING LONG VEHICLES

TECHNICAL FIELD

The present invention relates to a control system for operating long vehicles. In particular, the present invention relates to a control system for operating long and complex vehicles, such as heavy haul and freight trains, especially those with distributed power.

BACKGROUND ART

In order to increase the competitiveness of heavy industries such as mining, there has been a global trend in recent years towards the use of longer and heavier trains for the transportation of commodities. Among the benefits of this are improved energy efficiency and network capacity, as well as a reduction in the requirement for operational staff.

Freight and heavy haul trains can be between 600 metres and 4 kilometres in length and can weigh up to 50,000 tonnes. In-train forces in the Mega-Newton range may be generated and the routes taken by these trains may span numerous changes in track topography as well as speed limit. As a result, the operation of these trains requires the use of new control strategies outside the realm of classic automotive controls or the control strategies used for shorter trains.

In shorter trains (which are typically light and experience relatively low in-train forces), optimal train handling is typically time dependent focused on single objective energy optimisation for a given time target. Thus, human controlled optimal train handling can be achieved for shorter trains.

In contrast, optimal train handling in heavy haul trains is a multi-objective problem of energy and in-train force minimisation, and the barriers to human controlled optimal train handling for these trains are significant. For instance, due to the relatively poor responsiveness of these trains, control actions for future topography may need to occur many seconds or minutes before the actual location is reached. Similarly, the response to changes in control or topography can be felt in the train for up to many minutes afterwards. Further, variations in train performance may occur due to component wear and degradation.

Some attempts to develop optimal driving strategies for heavy haul trains have been attempted. Early attempts, such as those described in U.S. Pat. Nos. 4,253,399, 4,344,364 and 7,822,491 focussed heavily on the single objective of energy savings, while later attempts (such as those described in U.S. Pat. Nos. 6,144,901, 8,594,865, 9,365,222, 9,233,696 and 9,950,722) recognised that the calculation of optimal driving strategies for heavy haul trains required finding a real-time solution to a multi-objective optimisation problem or an optimal control problem with constraints. However, these systems do not fully solve the complex issues associated with the several variations of distributed power (DP) trains with multiple locomotives in various positions in the train as determined by the operator or the owner.

The ability of a train control system to closely follow the optimal speed profile while minimising or keeping the in-train forces within a desired range is essential for achieving superior energy savings and safe, smooth train operation. A common challenge of a train control system is that some parameters of the train dynamics model are not known precisely, thereby contributing to control errors. An inaccuracy of even a few kilometres per hour in maintaining the speed target could lead to the loss of a significant amount of kinetic energy in large trains.

Another complication is in computational requirements. The determination of the full state space of the dynamical system including coupler forces and train kinematics, as suggested in some prior art requires extensive calculations or measurement of couplers' forces in real-time, which is not a straightforward task. As a result, there would be an advantage if it were possible to provide a computationally efficient method that would allow driving a long heavy haul train closely to the selected trip profile while adhering to the imposed speed and in-train force restrictions.

It will be clearly understood that, if a prior art publication is referred to herein, this reference does not constitute an admission that the publication forms part of the common general knowledge in the art in Australia or in any other country.

SUMMARY OF INVENTION

The present invention is directed to a control system and method for operating long vehicles, and in particular long trains, which may at least partially overcome at least one of the abovementioned disadvantages or provide the consumer with a useful or commercial choice.

With the foregoing in view, the present invention in one form, resides broadly in a method for operating a train comprising two or more locomotives, the method comprising the steps of:

a) Setting one or more locomotive control levels and choosing a selected route of travel;
b) Calculating a target train speed profile and a target in-train force profile over at least a portion of the selected route;
c) Measuring one or more operating parameters related to the operation of the train;
d) Calculating a future train speed profile and a future in-train force profile for a future period based on at least one of the one or more operating parameters, at least one of the one or more locomotive control levels and one or more pieces of information relating to the selected route;
e) Calculating adjusted locomotive speed control levels relating to the one or more operating parameters based on a difference between the target train speed profile and the future train speed profile, the adjusted locomotive control levels being adapted to maintain the target train speed profile over the future period;
f) Calculating adjusted in-train force control levels relating to the one or more operating parameters based on a difference between the target in-train force profile and the future in-train force profile, the adjusted in-train force control levels being adapted to maintain the target in-train force profile below a target level over the future period;
g) Dividing the adjusted locomotive control levels and the adjusted in-train force control levels between the two or more locomotives to form locomotive-specific locomotive control levels for each of the two or more locomotives, the locomotive-specific locomotive control levels being at least partially adapted to control and/or balance in-train force levels below the target level;
h) Provide locomotive-specific locomotive control levels for communication to each of the two or more locomotives; and i) Operating each of the two or more locomotives according to the locomotive-specific locomotive control levels.

It will be understood that the term "locomotives" may be used to refer to individual locomotives within the train consist, or locomotive groups. By locomotive groups, it is meant that two or more locomotives may be located adjacent, or in close proximity, to one another in the train consist. Thus, in embodiments of the invention in which at least two locomotives are in a locomotive group they may effectively act as a single locomotive.

A train consist may include two or more individual locomotives, two or more locomotive groups, or a combination of at least one individual locomotive and at least one locomotive group.

It is envisaged that the present invention may be used in trains having any suitable train consist. For instance, the present invention may be used in simple head end trains or complicated train configurations using distributed locomotive placements in-train, and so on. In such embodiments, it is envisaged that the method of the present invention will be performed using a control system (specifically, an electronic control system) installed in a locomotive.

The present invention may also be used in other applications. For instance, the present invention may be incorporated into train planning and scheduling systems (and, specifically, electronic train planning and scheduling systems). In these embodiments, the present invention may be used to improve and/or optimise train operation speeds and controls. This improvement and/or optimisation may be over an entire train route or network, or within sections of the route in an overall train signalling and scheduling network.

In this embodiment, it is envisaged that the method of the present invention will be performed using a control system (specifically, an electronic control system) installed in a control room, such as a train signalling control room. It is envisaged that the control system embodying the method of the present invention will be used to provide optimal speed profiles and controls to at least one train operating in the network based on data received wirelessly by the control system from the at least one train. More preferably, the control system embodying the method of the present invention may be used to provide optimal speed profiles and controls to all of the trains operating in the network based on data received wirelessly by the control system from the trains.

The one or more locomotive control levels may be of any suitable form. For instance, the one or more locomotive control levels may include one or more of the throttle power (for instance, for each of the two or more locomotives), the dynamic or regenerative brakes (for instance, for each of the two or more locomotives), on-board energy storage management (for instance, for each of the two or more locomotives or connected energy storage vehicles) the train brake operation (for the entire train and/or for each of the two or more locomotives), the train consist, the train load, the train load distribution, a target value of in-train forces and so on. In embodiments of the invention in which the locomotive control forces include a target value of in-train forces, it is envisaged that the target value may be a maximum value of in-train forces. In this embodiment, it is preferred that the actual value of in-train forces in the train does not exceed the target value. Thus, it is envisaged that the train may be operated in such a manner as to ensure that the in-train forces do not exceed the target value.

In some embodiments, the locomotive control levels, when referring to locomotives within a close coupled locomotive group that act effectively as a single locomotive, in which case, controls of the same type may be equal or unequal control levels. However, in other embodiments of the invention, the locomotive control levels may be configured to control two or more locomotive groups synchronised, aysnchronised control of the same type (allowing just traction or braking) and aysnchronised control of the opposing type (allowing simultaneous traction and braking within the train). Thus, in these embodiments of the invention, the locomotive control levels may be configured to make use of one or more of traction, dynamic braking and air braking in order to operate the train (and, more particularly, to improve and/or optimise the control of the operation of the train).

In some embodiments of the invention the locomotive control levels may be current locomotive control levels, future locomotive control levels, or a combination of the two.

Preferably, the train may be associated with a locomotive control module. It is envisaged that the one or more locomotive control levels may be set in the locomotive control module. The locomotive control module may be located on the train, or may be located remote to the train. Regardless of its location, however, it is envisaged that the locomotive control module will be in electronic communication with the train. More specifically, the locomotive control module may be in electronic communication with each of the two or more locomotives of the train. Yet more specifically, the locomotive control module may be in electronic communication with a locomotive-specific control module associated with each of the two or more locomotives.

The one or more locomotive control levels may be set manually (e.g. by a user where the control system is used in informational advice mode), or may be set automatically based on the values of the locomotive control module or may be set using a combination of the two. In some embodiments, the locomotive control module may be provided with one or more rules (e.g. one or more electronic rules) that determine which of the one or more locomotive control levels take precedence based on the values of the locomotive control levels. In further embodiments of the invention, the same plurality of locomotive control levels may be set in every instance.

The target train speed profile and the target in-train force profile may be calculated over any suitable portion of the selected route. In some embodiments of the invention, the target train speed profile and the target in-train force profile may be calculated over the entire selected route. Alternatively, the target train speed profile and the target in-train force profile may be calculated over only a portion of the selected route. In other embodiments of the invention, a target train speed profile and a target in-train force profile may be calculated over each of a plurality of portions of the selected route. The target train speed profile and the target in-train force profile may be calculated over the same portions of the selected route as one another, or different portions of the route to one another. Preferably, the target train speed profile and the target in-train force profile are calculated over the same portions of the selected route as one another.

In embodiments of the invention in which the target train speed profile and the target in-train force profile are calculated over a portion of the selected route, the portion of the selected route over which the target train speed profile and the target in-train force profile are calculated may be selected using any suitable technique. For instance, the route may be broken down into portions over which the target speed profile and the target in-train force profile are calculated based on distance, proportion of the overall route or the like. Alternatively, the route may be broken down into portions over which the target speed profile and the target in-train force profile are calculated based on topography, curvature, maintenance conditions and/or temporary speed limits. For example, the target train speed profile and the target in-train force profile may be calculated over portions of the selected route that are relatively flat, have ascending portions, have descending portions, or have a speed limit associated with them (for instance, when passing through built-up areas).

The purpose of calculating the target train speed profile may be simply to determine the speed at which the train must travel (either the average speed, or, more preferably, the speed that the train must travel at over regions of different or changing topography) to arrive at its destination within a particular time.

More preferably, however, the target train speed profile may be calculated to determine the train speed at which the train may be operated with relatively high efficiency. It will be understood that the efficiency of the operation of the train may depend on numerous factors, including minimising fuel consumption within any time and speed restrictions, minimising in-train forces (or at least keeping in-train forces within safe limits), minimising maintenance costs by, for instance, reducing brake wear by minimising the amount of braking (and particularly heavy braking) required or the like, and distributing a required control output between the two or more locomotives for any given train consist.

By way of further explanation, it will be understood that, for instance, when the train is ascending a hill, the train speed may be reduced but energy or fuel consumption may increase. Similarly, when descending a hill, the energy or fuel consumption may decrease but braking may be required in order to maintain the train speed within a designated speed limit. Thus, the purpose of the train speed profile may be to ensure efficient operation of the train during the entire journey, taking changes in topography or other environmental factors into consideration. Other factors taken into consideration may include the minimisation of in-train forces. It will be understood that the term "in-train forces" refers to forces between adjacent rolling stock within the train (the term rolling stock here covering both powered and non-powered railway vehicles), and particularly the forces in the couplers between adjacent rolling stock. It will be understood that minimising in-train forces is important so as to prevent coupling and vehicle structural failures and excessive forces which may cause instability on curves.

The target in-train force profile is preferably calculated in order to ensure that the in-train forces within the train over the at least a portion of the route are minimised, or at least kept within safe limits. It is envisaged that the safe limits may be defined by a target value of in-train forces. Preferably, the actual in-train forces within the train are maintained at a level that does not exceed the target value.

As previously stated, the term in-train forces refers to forces between adjacent rolling stock within the train, and particularly the forces in the couplers between adjacent rolling stock. Preferably, the target in-train force profile may be calculated to determine the operating parameters at which the train may be operated in order to ensure that the in-train forces do not exceed the target value. It will be understood that the in-train forces may depend on numerous factors including speed, changes in speed, the amount of braking (and particularly heavy braking) required, the topography of the track (include ascending portions of track, descending portions of track, curved portions of track etc.) or the like. In addition, the in-train forces may vary within the train consist. For instance, it is envisaged that in-train forces may differ in a section of the train travelling uphill compared to a section of the train travelling downhill, and even to a section of the train passing over the summit of a hill.

In a preferred embodiment of the invention, the target train speed profile and the target in-train forces profile may be calculated using a processor. Any suitable processor may be used, although in a preferred embodiment of the invention, the processor may be electronically associated with the locomotive control module.

The one or more operating parameters related to the operation of the train may be of any suitable type and may be associated with any suitable aspect of the operation of the train. For instance, the one or more operating parameters may include one or more travel parameters. The travel parameters may include the train position (e.g. GPS co-ordinates, elevation, heading or the like), the current train speed, the speed limit associated with the current location of the train, signalling information (such as signalling information associated with the current location of the train), and so on.

The one or more operating parameters may also include one or more train operational parameters relating to changes in the performance of the two or more locomotives such as, but not limited to, changes in fuel or energy consumption, changes in braking performance, changes in in-train forces, and so on.

The one or more operating parameters may also include data relating to the one or more locomotive control levels.

The one or more operating parameters may be measured using any suitable technique. For instance, one or more sensors adapted to measure at least one of the one or more operating parameters may be provided. It is envisaged that the one or more sensors may be provided in electronic communication with the locomotive control module and/or the processor associated with the locomotive control module. Alternatively, the one or more sensors may be provided in electronic communication with one or more electronic databases adapted to store, in non-transient memory, data relating to the one or more operating parameters.

In a most preferred embodiment of the invention, the one or more sensors may be provided in electronic communication with both the locomotive control module and/or the processor associated with the locomotive control module and one or more electronic databases adapted to store, in non-transient memory, data relating to the one or more operating parameters.

The one or more sensors may be electronically connected to the locomotive control module and/or the processor and the one or more electronic databases in any suitable manner. For instance, at least one of the one or more sensors may be electronically connected to the locomotive control module and/or the processor and the one or more electronic databases via one or more wires. Alternatively, at least one of the one or more sensors may be wirelessly electronically connected to the locomotive control module and/or the processor and the one or more electronic databases.

The one or more sensors may include sensors adapted to determine locomotive and train parameters such as throttle, dynamic or regenerative braking, energy storage states, speed, energy or fuel consumption, in-train forces, elevation, heading or the like. Alternatively, at least one of the one or more operating parameters may be obtained from the train's own systems or gauges (such as a speedometer). In other embodiments of the invention, at least one of the one or more operating parameters may be obtained by a GPS unit.

In a preferred embodiment of the invention, the one or more operating parameters may be measured periodically during the train's journey between origin and destination. The periodic measurement of the operating parameters may be based on a predetermined period of time between measurements, or a predetermined distance travelled between measurements. In other embodiments, measurements of the one or more operating parameters may occur at irregular intervals, and may be triggered by such actions as changes in the operation of the train (for instance, when ascending or descending hills, when changes of speed occur due to changes in grades, speed limits, track signals or the like). In some embodiments, the measurement of the operating parameters may occur both at predetermined intervals of time or distance, and at times at which changes in the operation of the train are experienced.

As previously stated, the measurements of the operating parameters may be stored in one or more electronic databases. In this way, historical data relating to the train and the selected route may be collected over time. The historical data may be used audit and report on train operations. Further, the historical data may be used to identify decreases in locomotive performance or efficiency over time, as well as changes in conditions over the selected route (such as changes in track quality, temporary speed restrictions and so on).

In some embodiments of the invention, a single electronic database may be provided. More preferably, a plurality of electronic databases may be provided in which the measurements and operational parameters may be stored and, in some embodiments, archived. The operating parameters may be grouped in any suitable manner, although in a preferred embodiment of the invention the first group of operating parameters may include operating parameters relating to the position of the train, while the second group of operating parameters may include operating parameters relating to the operation of the train (e.g. speed, energy or fuel consumption, braking profiles, locomotive control levels information and so on).

In some embodiments, a further electronic database, in the form of a route database, may be provided. The route database may include at least the one or more pieces and/or types of information relating to the selected route. Any suitable pieces and/or types of information may be included in the database, such as, but not limited to track survey details including topographical information (including elevations, the grade of any topographical feature, curves or bends in the track and so on), information regarding speed limits, road crossings, bridges, stock crossings, sections of the route prone to flooding, snow, sand buildup, rockfalls, landslides or any other potential hazard, the location of cities or built-up areas, information regarding the condition of the track and the like.

In some embodiments, the route database may include information relating only to the selected route of travel. More preferably, however, the route database may include information relating to all available routes of travel for the train on the track networks that it operates. Preferably, the route database may be electronically connected to the locomotive control module and/or the processor. The route database may be located on the train, or may be located remote to the train.

As previously stated, a future train speed profile and a future in-train forces profile for a future period are calculated based on at least one of the one or more operating parameters, at least one of the one or more locomotive control levels and one or more pieces of information relating to the selected route. Preferably, the future train speed profile and the future in-train forces profile are calculated by the processor.

It is envisaged that, to calculate the future train speed profile and the future in-train forces profile, the processor may obtain measurements of the operating parameters directly from the one or more sensors. Alternatively, the processor may obtain measurements of the operating parameters from the electronic database. In a particular embodiment of the invention, the processor may obtain measurements of the operating parameters from each of the electronic databases.

Preferably, the processor may obtain the one or more locomotive control levels from the locomotive control module. Similarly, the processor may obtain the one or more pieces of information relating to the selected route from the route database.

It will be understood that the future train speed profile and the future in-train forces profile are calculated for the purpose of determining the locomotive control levels required during the future period to provide the most efficient operation of the train. The future period may be of any suitable type, and may include a period of time, a distance, or a combination of the two. The future period may be the same each time a future train speed profile and the future in-train forces profile are calculated or may vary. For instance, a future period may be calculated based on a set time (e.g. seconds, minutes, hours etc.) or may be calculated based on, for instance, a length of track having a constant speed limit, or the same topography, or a length of track between curves etc.

It is envisaged that the future train speed profile and the future in-train forces profile may, when calculated, be identical to the target train speed profile and the target in-train forces profile over the future period. However, the future train speed profile and the future in-train forces profile may differ from the target train speed profile and the future in-train forces profile for a number of reasons. For instance, if the train is ahead or behind schedule, the train speed in the future train speed profile may be increased or decreased from that of the target train speed profile to compensate. Alternatively, if changes in operating conditions have occurred (for instance unexpected climatic conditions along the selected route, changes to the condition of the track, degradation of the performance of the two or more locomotives etc.) the future train speed profile/or and the future in-train forces profile may vary from the target train speed profile and the target in-train forces profile for the future period in order to compensate and/or to improve the efficiency of the operation of the train.

In a preferred embodiment of the invention, the future train speed profile and the future in-train forces profile may be calculated by providing the one or more locomotive control levels and/or the one or more operating parameters with weightings. Any suitable weightings may be provided. It is envisaged that the weightings given to the one or more locomotive control levels and/or the one or more operating parameters may vary depending on factors including track topography. For instance, the weightings given to the one or more locomotive control levels and/or the one or more operating parameters may differ if, for instance, an uphill section of track is to be encountered compared to a relatively flat section of track through a built-up area.

Once the future train speed profile and the future in-train forces profile have been calculated, adjusted locomotive control levels may be calculated. Preferably, the adjusted locomotive control levels may be calculated by the processor and/or the locomotive control module.

The adjusted locomotive control levels may be calculated using any suitable technique. However, it is envisaged that the future train speed profile and the future in-train forces profile may be used to calculate the adjusted locomotive control levels in real time.

It is envisaged that the adjusted locomotive control levels may be adapted to ensure that the train operates in a manner so as to maintain the target train speed profile and the target in-train forces profile over the future period. However, in a preferred embodiment of the invention, the adjusted locomotive control levels may be adapted to ensure that the train operates in a manner so as to maintain an optimised target train speed profile and an optimised in-train forces profile over the future period while also minimising the energy or fuel consumption of the two or more locomotives and minimising the in-train forces.

As previously stated, the adjusted locomotive control levels are divided between the two or more locomotives to form locomotive-specific locomotive control settings. The division of the adjusted locomotive control levels between the two or more locomotives may be achieved using any suitable technique. However, it will be understood that the purpose of dividing the adjusted locomotive control levels between the two or more locomotives is to optimise the performance of each locomotive to achieve the optimised future train speed profile and the future in-train forces profile while minimising energy or fuel consumption and in-train forces within the train. Thus, the output (in terms of throttle power, brake operation, dynamic performance and so on) of each of the two or more locomotives set by the respective locomotive-specific locomotive control settings may differ from one another.

In some embodiments of the invention, braking control levels for each of the two or more locomotives may be determined based on a number of parameters. For instance, the braking control levels may be determined based on one or more of the situational braking needs and the physical train (or locomotive) braking characteristics. Other parameters may include current system states and design limits such as, but not limited to, brake application type, minimum, maximum and emergency brake levels, brake system fill times, minimum and maximum air brake hold intervals (for system stabilisation and the prevention of brake fade), graduated application and release (if applicable). The braking control levels may be applied to the operation of the train parametrically or may be communicated directly to the braking system of at least one of the two or more locomotives. It is envisaged that the braking control levels are communicated to locomotive systems using any suitable technique.

In some embodiments of the invention, the division of the adjusted locomotive control levels between the two or more locomotives to form the locomotive-specific locomotive control levels may be determined using one or more parameters, including the present location of the train and/or each of the two or more locomotives, the train length and mass, the track profile or track topography to be encountered during the future period, the train consist, the location of the two or more locomotives within the train and so on.

As an example, if, when the locomotive-specific locomotive control levels are calculated, a first locomotive in a train is travelling uphill while a second locomotive in a train is travelling downhill, the distribution of locomotive-specific locomotive control levels between the first locomotive and the second locomotive m be different. It is envisaged that, in this situation, the locomotive-specific locomotive control level relating to the throttle power in the first locomotive may be higher or lower than the locomotive-specific locomotive control level relating to the throttle power in the second locomotive. Similarly, different dynamic or regenerative braking may be required for the second locomotive in comparison to the first locomotive. Dividing the adjusted locomotive control settings between the locomotives as locomotive-specific locomotive control levels allows the performance of each locomotive to be optimised based on the conditions being experienced (or to be experienced over at least a portion of the future time period) by each locomotive. It will be understood, however, that the performance of each locomotive is preferably optimised within the bounds of the future train speed profile. Thus, it is envisaged that the energy or fuel consumption and in-train forces of each locomotive will not be changed to a point where the train no longer complies with the future train speed limits as defined by the rail network.

While the locomotive-specific locomotive control levels may be used to optimise the performance of each locomotive in the train, it is also envisaged that the locomotive-specific locomotive control levels may be calculated so that the performance of one locomotive is not optimised at the expense of other locomotives or the overall train. Thus, it is envisaged that operating a first locomotive according to its locomotive-specific locomotive control levels will not result in the locomotive being operated in such a manner so as to adversely affect the performance of another locomotive within the train.

The locomotive-specific locomotive control levels may be communicated to each of the two or more locomotives using any suitable technique. For instance, the locomotive-specific locomotive control levels may be communicated to a locomotive-specific control module associated with each of the two or more locomotives. In a preferred embodiment of the invention the locomotive-specific locomotive control levels may be communicated to a locomotive-specific control module associated with each of the two or more locomotives from the control module.

The locomotive-specific control modules may be located at any suitable location. For instance, the locomotive-specific control modules may be located on the train (for instance, in a single locomotive, or in each of the two or more locomotives) or may be located remote from the train. Regardless of their location, however, it is envisaged that the locomotive-specific control modules will be in electronic communication with the locomotives. More specifically, the locomotive-specific control module may be in electronic communication with the locomotive with which it is associated.

The locomotive-specific locomotive control levels may be set manually (e.g. by a user where the control system is used in informational advice mode), or may be set automatically. In embodiments where the locomotive-specific locomotive control levels are set manually, this may be by a driver located in the train, or may be performed remotely by an operator (such as a control room operator). In embodiments in which the locomotive-specific locomotive control levels are set automatically, this may be achieved using a control system, such as a DCS, SCADA, expert system, Driver Advisory System (DAS), Cruise Control System (CCS), Automatic Train Control System (ATCS) or driverless train operation system.

Once the locomotive-specific locomotive control levels are communicated to each of the two or more locomotives, the locomotives may be operated according to the locomotive-specific locomotive control levels for at least a portion of the future period. The locomotive-specific locomotive control levels may remain the same for the entire future period, or may change during the future period. For instance, the locomotive-specific locomotive control levels may vary during the future period to take into account changes in environmental conditions (track profile including changes in grade and curves in the track, speed limits, control signals etc.) that the locomotives may encounter during the future period. It is envisaged that these changes may be anticipated (and therefore taken into account when calculating the locomotive-specific locomotive control levels) through the use of the route database.

It is envisaged that, at or just before the end of the future period, the method may be repeated for a new future period. In this way, the operation of the locomotives may be continually adjusted to take into account both existing and future environmental conditions to which the locomotives will be exposed.

In another aspect, the invention resides broadly in a control system for controlling the operation of a train comprising two or more locomotives, the system comprising an electronic control module adapted to set and adjust one or more locomotive control levels associated with each of the two or more locomotives, a processor electronically associated with the electronic control module and adapted to receive, from one or more sensors, data relating to one or more operating parameters related to the operation of the train and an electronic route database electronically associated with the processor, the electronic route database including one or more pieces of information relating to a selected route of travel, wherein the processor is adapted to:

a) Calculate a target train speed profile and a target in-train force profile over at least a portion of the selected route;
b) Calculate a future train speed profile and a future in-train force profile over a future period of time based on the data received from the one or more sensors, the one or more locomotive control levels and the one or more pieces of information relating to the selected route;
c) Calculate adjusted locomotive speed control levels relating to the one or more operating parameters based on a difference between the target train speed profile and the future train speed profile, the adjusted locomotive speed control levels being adapted to maintain the target train speed profile over the future period of time;
d) Calculate adjusted in-train force control levels relating to the one or more operating parameters based on a difference between the target in-train force profile and the future in-train force profile, the adjusted in-train force control levels being adapted to maintain the target in-train force profile below a target level over the future period;
e) Divide the adjusted locomotive control levels and the adjusted in-train force control levels between the two or more locomotives to form locomotive-specific locomotive control levels for each of the two or more locomotives; and
f) Electronically communicate the locomotive-specific locomotive control levels to the control module to adjust the one or more locomotive control levels associated with each of the two or more locomotives.

It is envisaged that the adjusted locomotive control levels may be adapted to ensure that the train operates in a manner so as to maintain the target train speed profile over the future period. However, in a preferred embodiment of the invention, the adjusted locomotive control levels may be adapted to ensure that the train operates in a manner so as to maintain the optimised target train speed profile over the future period while also minimising the energy or fuel consumption of the two or more locomotives and minimising the in-train forces.

In a further aspect, the invention resides broadly in a method for operating a train comprising a locomotive, the method comprising the steps of:

a) Setting one or more locomotive control levels and choosing a selected route of travel;
b) Calculating a target train speed profile and a target in-train force profile over at least a portion of the selected route;
c) Measuring one or more operating parameters related to the operation of the train;
d) Calculating a future train speed profile and a future in-train force profile for a future period based on at least one of the one or more operating parameters, at least one of the one or more locomotive control levels and one or more pieces of information relating to the selected route;
e) Calculating adjusted locomotive speed control levels relating to the one or more operating parameters based on a difference between the target train speed profile and the future train speed profile, the adjusted locomotive control levels being adapted to maintain the target train speed profile over the future period;
f) Calculating adjusted in-train force control levels relating to the one or more operating parameters based on a difference between the target in-train force profile and the future in-train force profile, the adjusted in-train force control levels being adapted to maintain the target in-train force profile below a target level over the future period;
g) Operating the locomotive according to the adjusted locomotive speed control levels and adjusted in-train force control levels.

In yet another aspect, the invention resides broadly in a control system for controlling the operation of a train comprising a locomotive, the system comprising an electronic control module adapted to set and adjust one or more locomotive control levels associated with the locomotive, a processor electronically associated with the electronic control module and adapted to receive, from one or more sensors, data relating to one or more operating parameters related to the operation of the train and an electronic route database electronically associated with the processor, the electronic route database including one or more pieces of information relating to a selected route of travel, wherein the processor is adapted to:

a) Calculate a target train speed profile and a target in-train force profile over at least a portion of the selected route;
b) Calculate a future train speed profile and a future in-train force profile over a future period of time based on the data received from the one or more sensors, the one or more locomotive control levels and the one or more pieces of information relating to the selected route;
c) Calculate adjusted locomotive speed control levels relating to the one or more operating parameters based on a difference between the target train speed profile and the future train speed profile, the adjusted locomotive speed control levels being adapted to maintain the target train speed profile over the future period of time;
d) Calculate adjusted in-train force control levels relating to the one or more operating parameters based on a difference between the target in-train force profile and the future in-train force profile, the adjusted in-train force control levels being adapted to maintain the target in-train force profile below a target level over the future period; and e) Electronically communicate the adjusted locomotive speed control levels and the adjusted in-train force control levels to the control module to adjust the one or more locomotive control levels associated with the locomotive Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

Figure 1:
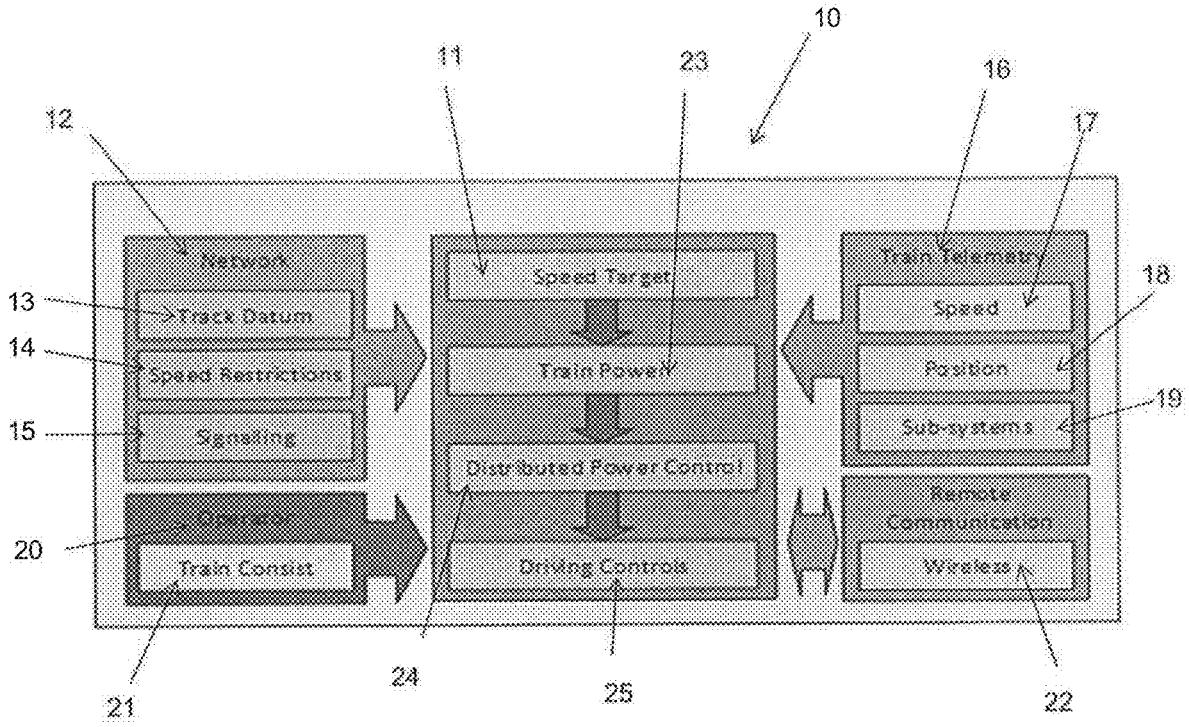
FIG. 1 illustrates a functional diagram of the method and control system according to an embodiment of the present invention.

FIG. 1 illustrates a functional diagram of the method and control system 10 according to an embodiment of the present invention. In very general terms, a train (not shown) is being operated under certain locomotive control levels according to a target train speed profile. The target train speed profile is adapted to give an optimised target speed profile to ensure efficient operation of the train based over a particular section of the train's route. By efficient operation, it is meant that the train will be operated in such as manner as to minimise fuel and/or energy consumption and in-train forces while complying with speed restrictions, delivery timeframes and so on.

As previously stated, the target train speed profile covers a section of the train's route under which the train is operated according to preselected locomotive control levels. For a future section of the route, a future train speed profile 11 is calculated. The optimised future train speed profile 11 is calculated over a future section of the train's route and is calculated using data from a number of sources. For instance, network data 12, preferably retrieved from one or more electronic databases associated with the train is used to calculate the optimised future train speed profile 11. In the embodiment of the invention shown in FIG. 1, the network data 12 includes information regarding the track 13 (including grades, curves, track condition and so on), speed restrictions 14 and train signal information 15.

In addition to the network data 12, train data 16 obtained from sensors associated with the train is used to calculated the future train speed profile 11. The telemetry data 16 in this embodiments of the invention includes train speed 17, GPS position 18 and information received from train sub-systems 19 (such as in-train forces, fuel and/or energy consumption and so on).

In this embodiment of the invention, other data, such as operator-inputted data 20 (for instance the train consist selection 21) or other data 22 transmitted wirelessly to the train.

Once the future train speed profile 11 is calculated, adjusted locomotive control levels 23 are calculated. The adjusted locomotive control levels 23 determine the manner in which the train is to be operated (brake operation, throttle power, dynamic operation and so on) over the future period in order to optimise the performance of the train through minimisation of in-train forces and energy/fuel consumption.

The adjusted locomotive control levels 23 are then divided between the two or more locomotives in the train to form locomotive-specific locomotive control levels 24. The locomotive-specific locomotive control levels 24 are based in part on the present location of each locomotive and the conditions to be encountered by each locomotive during the future period. This will be discussed further in connection with FIG. 3.

Once the locomotive-specific locomotive control levels 24 are calculated, the locomotive-specific locomotive control levels 24 are communicated electronically to each locomotive and the driving controls 25 of each locomotive are set so as to match or comply with the locomotive-specific locomotive control levels 24

A specific example of the calculations used in the present method is provided below. In a first step, the target speed profile for the trip or part of the trip that satisfies imposed speed limits and optimises the trip from the point of view of selected criteria (such as brake operation, throttle power etc.) The target speed profile could be either calculated prior to the trip or calculated during the trip in real time.

The difference between the target speed profile and the actual train speed profile for the future period is calculated. This is calculated using the following formula:

$$\Delta V(t_i)=V_{target}(t_i)-V_{predicted}(t_i),$$

$$i=0,1,2,\ldots,n, \text{ and } n=T_{forecast}/t_0,$$

Where $T_{forecast}$ is the future period, and $t_0$ is the time period of calculating speed forecast.

Figure 2:
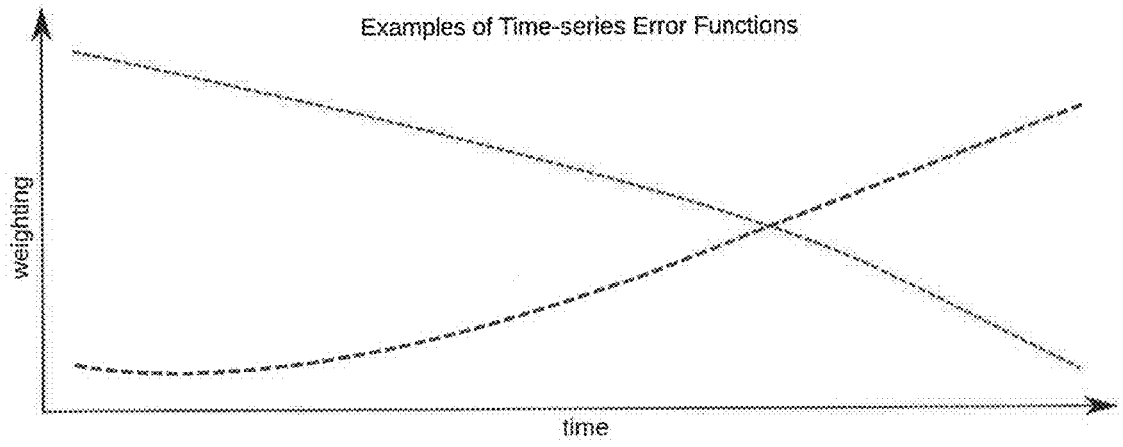
FIG. 2 illustrates a method of calculation of the control error for a future period of time according to an embodiment of the present invention.

Next, with reference to FIG. 2 of the present application, the control error is calculated according to the following formula:

$$\Delta E(t_0)=\Sigma k_{weight}(t_i)\Delta V(t_i), i=0,1,2,\ldots,n$$

Where $k_{weight}(t_i)$ is a unity function with weight coefficients $k_{weight}(t_i)$ derived from a train dynamic response to a step control input.

It is envisaged that the Control Value $CV(t_0)$ is proportional to the control error $\Delta E(t_0)$:

$$CV(t_0)=k_p\Delta E(t_0)$$

The Control Value represents a control percentage and may be fixed in the range of −200% to 100%, where the ranges 0 to 100% are tractive effort, −100% to <0% are dynamic brake, and <−100% is train brake. If the new Control Value is less than 1% variation from the previous Control Value it may be ignored. This may be used to ensure integral accumulation of the control error does not occur and also aligns with the discrete nature of the locomotive tractive and dynamic braking efforts.

Once the incremental change to the control signal is calculated, a check is performed by the locomotive control module that the train speed will continue to satisfy the speed limit during the predetermined forecast period, i.e.

$$V_{predicted}(t_i)<=V_{limit}(t_i)$$

and remains within the required threshold value from the target speed profile:

$$|V(t_i)-V_{Target}(t_i)|<=V_{threshold}$$

The calculated Control Value CV is then forwarded to a Distributed Power Control (DPC) module (referenced by the locomotive-specific locomotive control levels 24 in FIG. 1). The DPC unit calculates the optimal split of the required control adjustment between train locomotives using the present and the future delineated track profile under the train.

For a train with M locomotives the DPC module splits the required control value CV between train locomotives, so $$CV = \sum_{i}^{M} CVi$$

where i=1, 2 . . . M.

It is envisaged that in-train forces could be controlled by monitoring and maintaining the force differentials applied to consecutive parts of train located above delineated pieces of track. The DPC module operation is based in this concept.

The split of the control input is the variable that could be used for minimising the steady components of in-train forces and keeping them within the required limit while closely following the optimal or target train speed profile. The method and system of the present invention splits the required additional control signal in such a way to achieve a closest possible to the balanced distribution of forces applied to each section of the train located above a delineated piece of track. Another objective of the DP control algorithm is to ensure that $F_{diff}^{i}(t)$ remains within the required safe threshold limits $F_T$ all the time.

The equation below describes the total forces acting on each section of the train:

$$F\ \text{section}\ (i) = \sum_{j}^{Ni} [Fgrade(j) + Frr(j)] + \sum_{s}^{Mi} [Floco(s)]$$

Where j=1, 2 . . . Ni—number of train vehicles located on T section of the track, $F_{Grade}(j)$ and $F_{rr}$—respectively gravity and rolling resistance forces applied to $j^{th}$ vehicle located on the grade, and s=1, 2 . . . $M_i$—throttle or brake force generated by an sth loco located on the same linear section of the track, and where $\Sigma M_i$=M, the total number of locomotives in the train.

In general, at the time of calculating a DP split the train could be located on L track sections, so i=1, 2 . . . L. Providing L=1, the control request is split equally between train locomotives.

Figure 4:
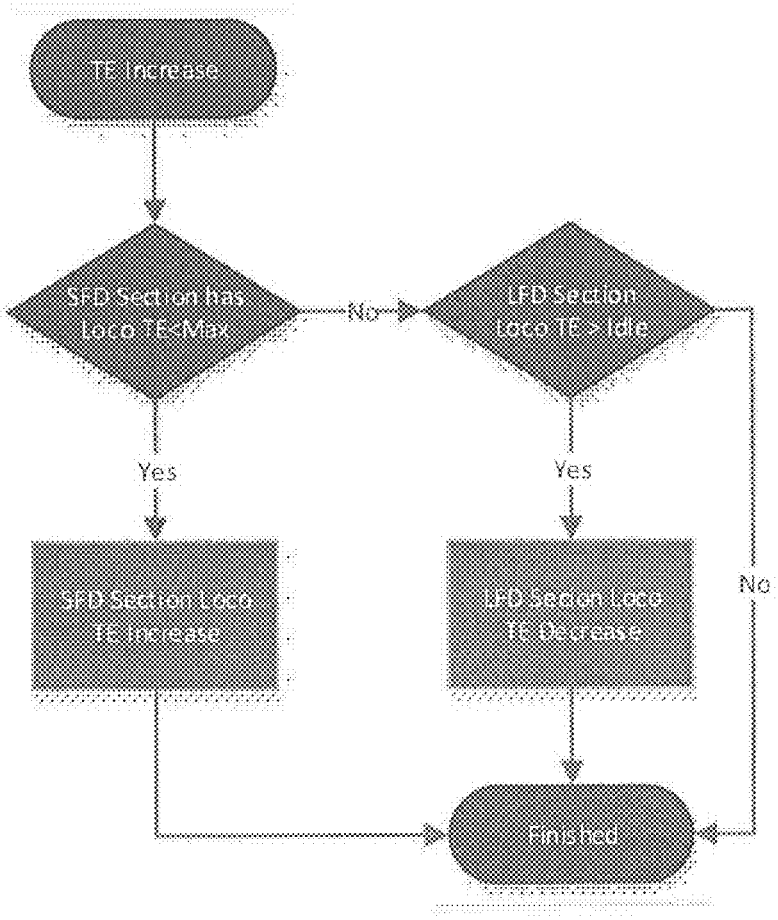
FIG. 4 illustrates a method for calculating the distributed power (DP) division between locomotives according to an embodiment of the present invention in the case of a request for additional power.

Assuming that $CV(t_0)>0$, i.e. additional traction effort (TE) is required for the precise follow of target speed profile. FIG. 4 illustrate the process where an increase in the traction effort is required.

The controller creates a descending ordered list of section force differentials:

$$F_{diff}^{i}=|F_{section}^{i}-F_{section}^{i-1}|$$

where i=1, 2 . . . L.

The convention is that the Smallest Force Differential (SFD) is the section with the force value closest to 0. The Largest Force Differential (LFD) is therefore the section with force value furthest from 0. The premise is the same whether the sections form a peak or a trough.

Starting at the top of the descending list the controller checks whether locomotive/s are available inside the region of the SFD and whether these locomotive/s are at max TE. The method for assigning a proportion of power to the locomotives depend on available information.

If no locomotives are available in the SFD, the additional traction is added to any other locomotive where the power increase would deliver the largest reduction of the maximum section differential existing in the train. If the reduction of the maximum differential is not possible, the power is added to the locomotive that would increase the maximum section differential by a minimal value, providing that after the increase $F_{diff}^{i}(t)$ remains within the required threshold value $F_T$ during the entire predetermined period of forecast.

In exceptional cases, when the forecasted section differential would exceed the chosen threshold at some point in time within the chosen period of forecast, the request for additional power is ignored as the implementation of the request may make train operation unsafe. In some extreme cases the need to keep force differential within the required limit may cause reduction of the power in order to ensure safe train operation. In this case the controller checks that the required reduction of the power would not cause the train to stall.

Figure 5:
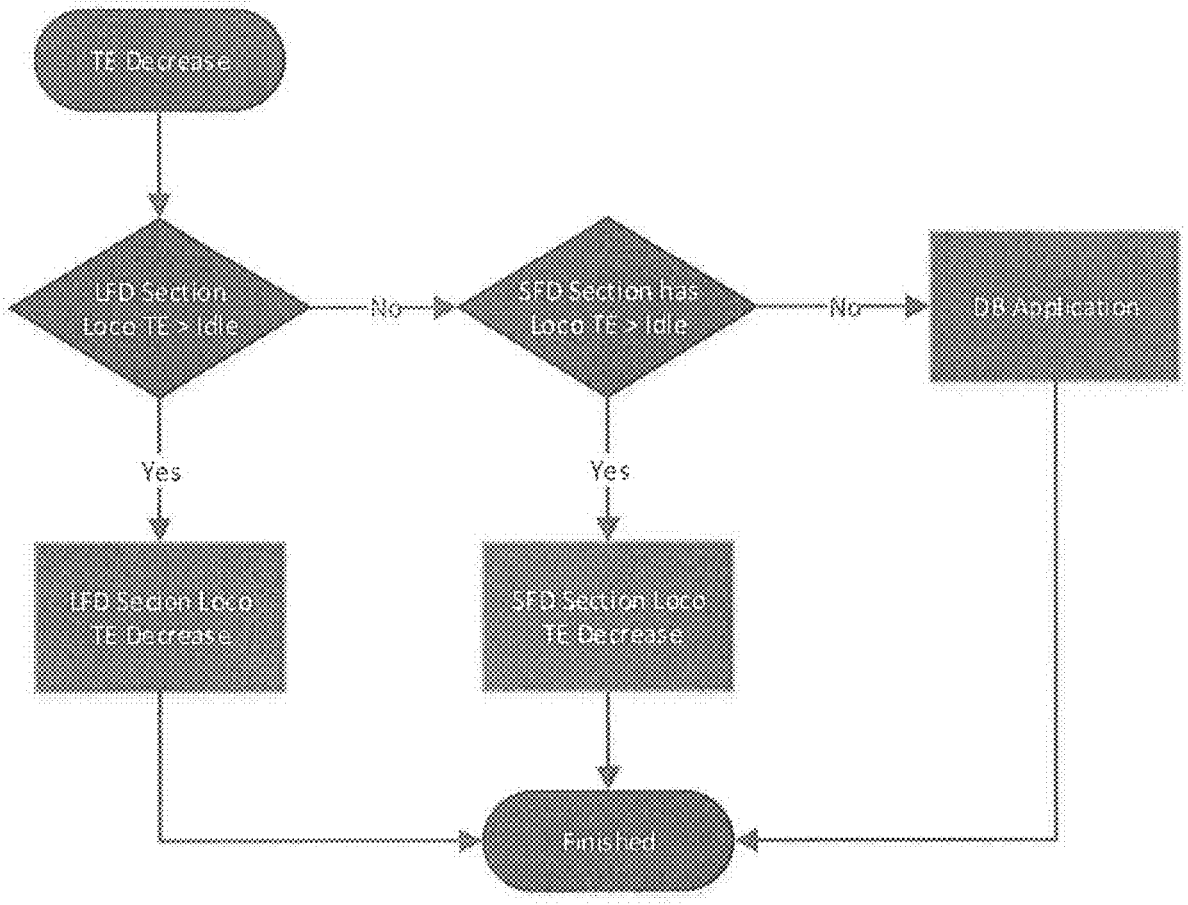
FIG. 5 illustrates a method for calculating the distributed power (DP) division between locomotives according to an embodiment of the present invention in the case of a request for reduced power.

It will be a common in long trains where a grade section will contain no locomotives at all. However, the described method always has the effect of reducing the maximum force differential in the train. The flowchart illustrated in FIG. 5 illustrates the process when a traction effort decrease is required.

Similar to the case of Tractive Effort (TE) increase, the controller analyses the list of descending section force differentials. The SFD and LFD conventions are the same as in the TE increase case described previously. In the TE decrease scenario power is first removed from the locomotive of the LFD to reduce the maximum section force differential providing there is a locomotive available. Once all power has been removed from the LFD locomotive/s, the request to reduce power is forwarded to another locomotive in the train, providing the reduction of its power would result in the largest decrease in the forecasted maximum force differential. In case there is no other locomotive that would achieve reduction of the maximum section force differential, then the request is forwarded to the locomotive where the reduction in the power would cause the smallest increase in the maximum section force differential, providing that following the decrease $F_{diff}^{i}(t)$ remains within the required threshold value FT during the entire predetermined period of forecast.

Once the TE is reduced to zero for all locomotives, and a further speed reduction is still required the controller must then determine if a Dynamic or regenerative Brake (DB) application can be made.

In classic driving control a pause is imposed between entering idle from the last TE application and the first DB application. The necessity for this approach in the patented method is not required as all in-train force effects are predicted and therefore handled implicitly by the method. The evaluation of the force differentials in the train will disallow a DB application until it is determined that the differentials will remain under $F_T$ value. Balancing of DB applications is carried out using the same methodology of differential comparison, but with control action to speed relationships reversed. Therefore, an increase in DB reduces speed and a decrease in DB to allow increase in speed. When maximum safe braking effort from DB is reached and further speed reduction is still required a train pneumatic braking application is necessary. This might need to occur when CV is <–100%. This is realised in the same way that TE is constrained to maintain safe in-train forces.

Train braking in long trains is either performed by conventional pneumatic braking or by Electronically Controlled Pneumatic Brakes (ECPB). The two systems have very different performance characteristics. Pneumatic braking takes significantly longer to actuate brakes in long trains and has the potential to introduce significant in-train forces, whereas, the electrical signalling characteristics of ECPB ensure all brakes are actuated in parallel. An important difference inherent in all pneumatic brakes is that these systems have response times governed by gas dynamics. Furthermore for conventional pneumatic brakes certain levels of control must be chosen and certain times must elapse between changes. Pneumatic braking is therefore added as discrete control levels and durations following normal brake and train operation rules and policies.

Due to these differences in performance the characteristics of the safe use of these brake systems should preferably be included in the prediction. Then, in the same way that power is either increased or decreased, the train brake contribution is set by the controller to keep within the safe operating constraints of the train and the brake system.

The methodology uses a combination of directly measured train performance and known parameters of performance in its prediction of future train state. For non-measured parameters these must be synchronised to actual train performance to ensure prediction accuracy.

Figure 3:
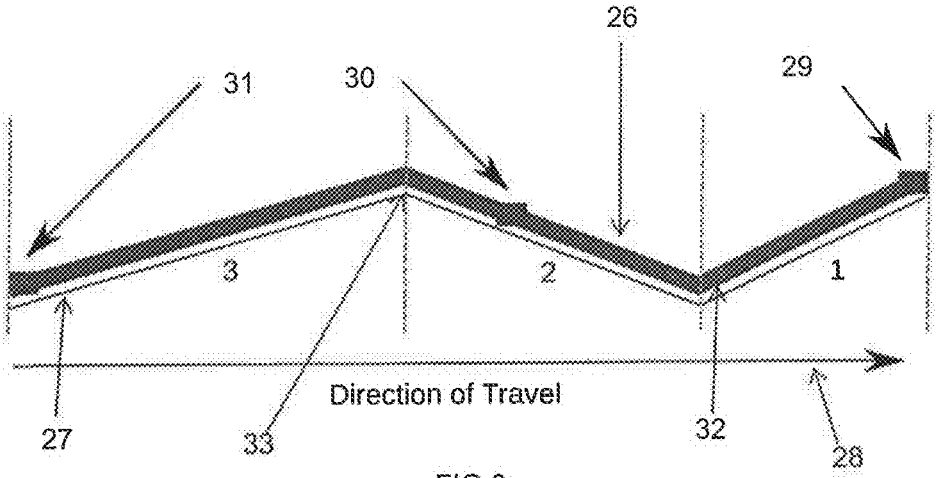
FIG. 3 illustrates an example of the position of a train along a section of track.

In FIG. 3 there is illustrated an example of the position of a train 26 along a section of track 27. The train 26 is travelling along the track 27 in the direction of travel indicated by arrow 28.

In this embodiment of the invention, the train 26 includes three locomotives: a lead locomotive 29 and two remote locomotives 30, 31. Each locomotive 29, 30, 31 is separated from the other locomotives 29,30, 31 by at least one unit of rolling stock 32.

It will be noted that the lead locomotive 29 is positioned at or near the top of an uphill section of the track 27, while the first of the remote locomotives 30 is positioned partway along a downhill section of track 27. The second of the remote locomotives 31 is located at the bottom of an uphill section of track 27. Given that the train 26 may be several kilometres in length, it may take some time for remote locomotive 30 to reach the position of the lead locomotive 29, and even longer for remote locomotive 31 to reach the position of the lead locomotive 29. During these periods of time, each locomotive 29, 30, 31 will encounter different environmental conditions (such as track topography) at different times. Thus, operating each locomotive 29, 30, 31 according to the specific environmental conditions that the locomotive 29, 30, 31 will encounter during the future period will assist in improving locomotive performance while reducing in-train forces.

In the example illustrated in FIG. 3, as the lead locomotive 29 is approaching the top of an uphill section of the track 27, increased throttle power may be required so that the lead locomotive 29 may crest the hill. However, increased braking may be required as the lead locomotive begins to travel downhill. Simultaneously, increased braking may initially be required by the first remote locomotive 30 as it completes the downhill section of track 27, but increase throttle power will be required as the first remote locomotive 30 begins to ascend the uphill section of track on which the first locomotive 29 is currently positioned.

On the other hand, the second remote locomotive 31 will require a relatively long period of increased throttle power as it climbs the uphill section of track 27 on which is it presently located.

It will be understood, however, that each locomotive 29, 30, 31 cannot be simply operated only according to the environmental conditions it will encounter. Instead, each locomotive 29, 30, 31 should be operated so as to take into consideration the operation of the other locomotives 29, 30, 31 within the train. For example, while minimal braking may optimise the performance of the first remote locomotive 30 on the downhill section of track 27, minimal braking may increase in-train forces between rolling stock at the top of hill 33 to an unacceptable level because the second remote locomotive 31 may be unable to travel fast enough uphill to keep up with the first remote locomotive 30, or the second remote locomotive 31 may be uphill to travel fast enough uphill to keep up with the first remote locomotive 30 but doing so would result in unacceptably high fuel and/or energy consumption.

Thus, it will be understood that while the locomotive-specific locomotive control levels may not permit individual locomotives 29, 30, 31 to operate at optimal; conditions for that locomotive, the locomotive-specific locomotive control levels function to ensure that individual locomotives 29, 30, 31 operate in a manner that optimises the performance of the train 26, in terms of minimising fuel and/or energy consumption and in-train forces, while also ensuring that the train 26 complies with external factors such as speed restrictions, signalling and any deadlines the train 26 is required to meet.

It should be noted that the DP train example given in FIG. 3 is just one of many possible variations. The example in FIG. 3 is known as a 'head—mid—tail' configuration, and it is also true that the mid locomotive may be positioned at different locations in-train. A list of the possible configurations for three locomotives includes: 'head—mid—tail' or 'head—in-train—tail'. In the latter configuration, the in-train locomotive may be located at any suitable position within the length of the train. For instance, the in-train locomotive may be positioned at 20%, 50%, 66%, 75% etc. of the length of the train.

In embodiments of the invention in which two locomotives are present, it is envisaged that the configuration of the two locomotives may be either "head—tail" or 'head—in-train', with the second locomotive positioned at, for example, 20%, 50%, 66%, 75% etc. of the length of the train. It is also envisaged that a train with 4 locomotives may be utilised. In this embodiment of the invention, the configuration of the 4 locomotives will be 'head—in-train—in-train—tail', with the two in-train locomotives being positioned at any suitable location along the length of the train between the front (head) and back (tail).

Some specific examples of DP train consists are set out below:

Two Locomotives: Head—Tail

A combination of:

- head locomotive(s) (comprising a single locomotive or a locomotive group); and
- tail locomotive(s) (comprising a single locomotive or a locomotive group).

Two Locomotives: Head—In-Train

A combination of:

- head locomotive(s) (comprising a single locomotive or a locomotive group); and
- in-train locomotive(s) (comprising a single locomotive or a locomotive group).

Three Locomotives: Head—In-Train—Tail

A combination of:

- head locomotive(s) (comprising a single locomotive or a locomotive group);
- in-train locomotive(s) (comprising a single locomotive or a locomotive group); and
- tail locomotive(s) (comprising a single locomotive or a locomotive group).

Three Locomotives: Head—In-Train—In-Train

A combination of:

- head locomotive(s) (comprising a single locomotive or a locomotive group);
- first in-train locomotive(s) (comprising a single locomotive or a locomotive group); and
- second in-train locomotive (s) (comprising a single locomotive or a locomotive group).

It will be understood that the configurations listed above are intended to be illustrative only and are by no means an exhaustive list of possible train configurations.

In all of the examples given above, it will be understood that the locomotives will be separated from one another in the train consist by a wagon rake or group comprising one or more wagons.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A method for operating a train comprising two or more locomotives, the method comprising the steps of:

setting one or more locomotive control levels and choosing a selected route of travel;

calculating a target train speed profile and a target in-train force profile over at least a portion of the selected route;

measuring one or more operating parameters related to the operation of the train;

calculating a future train speed profile and a future in-train force profile for a future period based on at least one of the one or more operating parameters, at least one of the one or more locomotive control levels and one or more pieces of information relating to the selected route;

calculating adjusted locomotive speed control levels relating to the one or more operating parameters based on a difference between the target train speed profile and the future train speed profile, the adjusted locomotive control levels being adapted to maintain the target train speed profile over the future period;

calculating adjusted in-train force control levels relating to the one or more operating parameters based on a difference between the target in-train force profile and the future in-train force profile, the adjusted in-train force control levels being adapted to maintain the target in-train force profile below a target level over the future period;

dividing the adjusted locomotive control levels and the adjusted in-train force control levels between the two or more locomotives to form locomotive-specific locomotive control levels for each of the two or more locomotives, the locomotive-specific locomotive control levels being at least partially adapted to control and/or balance in-train force levels below the target level provide locomotive-specific locomotive control levels for communication to each of the two or more locomotives; and operating each of the two or more locomotives according to the locomotive-specific locomotive control levels.

2. The method according to claim 1 wherein the method is performed using an electronic control system installed in a locomotive or in a train signalling control room.

3. The method according to claim 1 wherein the one or more locomotive control levels include one or more of throttle power, dynamic or regenerative brakes, on-board energy storage management, train brake operation, train consist, train load, train load distribution and a target value of in-train forces.

4. The method according to claim 1 wherein the locomotive control levels are set in a locomotive control module in electronic communication with the train.

5. The method according to claim 4 wherein the locomotive control module is in electronic communication with a locomotive-specific control module associated with each of the two or more locomotives.

6. The method according to claim 4 wherein the target train speed profile and the target in-train forces profile are calculated using a processor associated with the locomotive control module.

7. The method according to claim 1 wherein the target train speed profile and the target in-train force profile are calculated over each of a plurality of portions of the selected route.

8. The method according to claim 1 wherein the operating parameters include one or more travel parameters, train operational parameters or data relating to the one or more locomotive control levels.

9. The method according to claim 6 wherein the one or more pieces of information relating to the selected route are included in a route database electronically connected to the locomotive control module and/or the processor.

10. The method according to claim 1 wherein the future train speed profile and the future in-train forces profile are calculated by providing the one or more locomotive control levels and/or the one or more operating parameters with weightings.

11. The method according to claim 6 wherein the adjusted locomotive control levels are calculated by the processor and/or the locomotive control module.

12. The method according to any claim 1 wherein dividing the adjusted locomotive control levels between the two or more locomotives to form the locomotive-specific locomotive control levels id determined using one or more of the following parameters: present location of the train and/or each of the two or more locomotives, train length and mass, track profile or track topography to be encountered during the future period, train consist, and location of the two or more locomotives within the train.

13. The method according to claim 1 wherein the locomotive-specific locomotive control levels are calculated so that the performance of one locomotive is not optimised at the expense of other locomotives or the train.

14. The method according to claim 1 wherein the locomotives are operated according to the locomotive-specific locomotive control levels for at least a portion of the future period.

15. The method according to claim 1 wherein at or just before the end of the future period, the method is repeated for a new future period.

16. A control system for controlling the operation of a train comprising two or more locomotives, the system comprising an electronic control module adapted to set and adjust one or more locomotive control levels associated with each of the two or more locomotives, a processor electronically associated with the electronic control module and adapted to receive, from one or more sensors, data relating to one or more operating parameters related to the operation of the train and an electronic route database electronically associated with the processor, the electronic route database including one or more pieces of information relating to a selected route of travel, wherein the processor is adapted to:

calculate a target train speed profile and a target in-train force profile over at least a portion of the selected route;

calculate a future train speed profile and a future in-train force profile over a future period of time based on the data received from the one or more sensors, the one or more locomotive control levels and the one or more pieces of information relating to the selected route;

calculate adjusted locomotive speed control levels relating to the one or more operating parameters based on a difference between the target train speed profile and the future train speed profile, the adjusted locomotive speed control levels being adapted to maintain the target train speed profile over the future period of time;

calculate adjusted in-train force control levels relating to the one or more operating parameters based on a difference between the target in-train force profile and the future in-train force profile, the adjusted in-train force control levels being adapted to maintain the target in-train force profile below a target level over the future period;

divide the adjusted locomotive control levels and the adjusted in-train force control levels between the two or more locomotives to form locomotive-specific locomotive control levels for each of the two or more locomotives; and electronically communicate the locomotive-specific locomotive control levels to the control module to adjust the one or more locomotive control levels associated with each of the two or more locomotives.

17. A method for operating a train comprising a locomotive, the method comprising:

setting one or more locomotive control levels and choosing a selected route of travel;

calculating a target train speed profile and a target in-train force profile over at least a portion of the selected route;

measuring one or more operating parameters related to the operation of the train;

calculating a future train speed profile and a future in-train force profile for a future period based on at least one of the one or more operating parameters, at least one of the one or more locomotive control levels and one or more pieces of information relating to the selected route;

calculating adjusted locomotive speed control levels relating to the one or more operating parameters based on a difference between the target train speed profile and the future train speed profile, the adjusted locomotive control levels being adapted to maintain the target train speed profile over the future period;

calculating adjusted in-train force control levels relating to the one or more operating parameters based on a difference between the target in-train force profile and the future in-train force profile, the adjusted in-train force control levels being adapted to maintain the target in-train force profile below a target level over the future period;

operating the locomotive according to the adjusted locomotive speed control levels and adjusted in-train force control levels.

18. A control system for controlling the operation of a train comprising a locomotive, the system comprising an electronic control module adapted to set and adjust one or more locomotive control levels associated with the locomotive, a processor electronically associated with the electronic control module and adapted to receive, from one or more sensors, data relating to one or more operating parameters related to the operation of the train and an electronic route database electronically associated with the processor, the electronic route database including one or more pieces of information relating to a selected route of travel, wherein the processor is adapted to:

calculate a target train speed profile and a target in-train force profile over at least a portion of the selected route;

calculate a future train speed profile and a future in-train force profile over a future period of time based on the data received from the one or more sensors, the one or more locomotive control levels and the one or more pieces of information relating to the selected route;

calculate adjusted locomotive speed control levels relating to the one or more operating parameters based on a difference between the target train speed profile and the future train speed profile, the adjusted locomotive speed control levels being adapted to maintain the target train speed profile over the future period of time;

calculate adjusted in-train force control levels relating to the one or more operating parameters based on a difference between the target in-train force profile and the future in-train force profile, the adjusted in-train force control levels being adapted to maintain the target in-train force profile below a target level over the future period; and electronically communicate the adjusted locomotive speed control levels and the adjusted in-train force control levels to the control module to adjust the one or more locomotive control levels associated with the locomotive.

19. The method for operating a train comprising two or more locomotives according claim 1 wherein the locomotive control levels are configured to use one or more of traction, dynamic braking and air braking in order to improve control of the operation of the train.

20. The control system according to claim 16 wherein the locomotive control levels are configured to use one or more of traction, dynamic braking and air braking in order to improve control of the operation of the train.

* * * * *